US009536693B2

(12) United States Patent
Gottschalk

(10) Patent No.: US 9,536,693 B2
(45) Date of Patent: Jan. 3, 2017

(54) ELECTRICAL SWITCHING APPARATUS AND TRIP ASSEMBLY THEREFOR

(71) Applicant: EATON CORPORATION, Cleveland, OH (US)

(72) Inventor: Andrew Lawrence Gottschalk, Monaca, PA (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/665,073

(22) Filed: Mar. 23, 2015

(65) Prior Publication Data

US 2016/0284499 A1 Sep. 29, 2016

(51) Int. Cl.
*H01H 7/08* (2006.01)
*H01H 71/10* (2006.01)

(52) U.S. Cl.
CPC ..... *H01H 71/10* (2013.01)

(58) Field of Classification Search
CPC ..... H01H 71/10; H01H 71/505; H01H 3/32
USPC ..... 200/318, 39 R, 337, 400–401, 244, 250
See application file for complete search history.

(56) References Cited

U.S. PATENT DOCUMENTS 7,459,650 B2 * 12/2008 Weister ..... H01H 71/505 200/400
7,518,074 B2 * 4/2009 Weister ..... H01H 1/225 200/244
7,518,076 B1 4/2009 Gottschalk et al.
7,633,031 B2 12/2009 Wehrli, III et al.
7,646,270 B2 * 1/2010 Spitsberg ..... H01H 3/3052 200/42.01
7,687,733 B2 3/2010 Weister et al.
8,319,133 B2 11/2012 Gottschalk et al.
8,519,289 B2 8/2013 Schaltenbrand et al.
2011/0062006 A1 3/2011 Gottschalk et al.

FOREIGN PATENT DOCUMENTS

EP 2 001 030 A1 12/2008
EP 2 549 499 A1 1/2013

OTHER PUBLICATIONS

European Patent Office, "International Search Report and Written Opinion" (for corresponding application PCT/US2016/020564), May 19, 2016, 12 pp.

* cited by examiner

*Primary Examiner* — Edwin A. Leon
(74) *Attorney, Agent, or Firm* — Eckert Seamans; John Powers; Grant Coffield

(57) ABSTRACT

A trip assembly is for an electrical switching apparatus. The electrical switching apparatus includes a housing, separable contacts enclosed by the housing, and an operating mechanism for opening and closing the separable contacts. The operating mechanism includes a poleshaft and a trip D-shaft. The trip assembly comprises: a yoke assembly comprising a yoke member and a trip pin coupled to the yoke member, the yoke member being structured to be coupled to the poleshaft; and a link assembly comprising a linking member, the linking member being structured to cooperate with each of the trip pin and the trip D-shaft. When the yoke member moves in response to a trip condition, the linking member is structured to transmit movement of the yoke member into movement of the trip D-shaft.

16 Claims, 10 Drawing Sheets

ELECTRICAL SWITCHING APPARATUS AND TRIP ASSEMBLY THEREFOR

BACKGROUND

Field

The disclosed concept relates generally to electrical switching apparatus and, more particularly, to electrical switching apparatus, such as circuit breakers. The disclosed concept also relates to trip assemblies for circuit breakers.

Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts that are separable from the stationary electrical contacts.

Among other components, the operating mechanisms of some low and medium voltage circuit breakers, for example, typically include a poleshaft, a trip actuator assembly, a closing assembly and an opening assembly. The trip actuator assembly responds to the trip unit and actuates the operating mechanism. The closing assembly and the opening assembly may have some common elements, which are structured to move the movable electrical contacts between a first, open position, wherein the movable and stationary electrical contacts are separated, and a second, closed position, wherein the movable and stationary electrical contacts are electrically connected. Specifically, the movable electrical contacts are coupled to the poleshaft. Elements of both the closing assembly and the opening assembly, which are also pivotably coupled to the poleshaft, pivot the poleshaft in order to effectuate the closing and opening of the electrical contacts.

It is important that sufficient tripping force is provided from the trip actuator to trip the circuit breaker under relatively high interruption forces. A variety of circuit breaker design factors such as, for example, size constraints associated with the desire to minimize the overall footprint or size of the circuit breaker, and positioning and interaction of internal components, can make it difficult to achieve the requisite amount of force.

There is, therefore, room for improvement in electrical switching apparatus, such as circuit breakers, and in trip assemblies therefor.

SUMMARY

These needs and others are met by embodiments of the disclosed concept, which are directed to a trip assembly for an electrical switching apparatus, such as a circuit breaker.

As one aspect of the disclosed concept, a trip assembly for an electrical switching apparatus is provided. The electrical switching apparatus includes a housing, separable contacts enclosed by the housing, and an operating mechanism for opening and closing the separable contacts. The operating mechanism includes a poleshaft and a trip D-shaft. The trip assembly comprises: a yoke assembly comprising a yoke member and a trip pin coupled to the yoke member, the yoke member being structured to be coupled to the poleshaft; and a link assembly comprising a linking member, the linking member being structured to cooperate with each of the trip pin and the trip D-shaft. When the yoke member moves in response to a trip condition, the linking member is structured to transmit movement of the yoke member into movement of the trip D-shaft.

As another aspect of the disclosed concept, an electrical switching apparatus comprises: a housing; separable contacts enclosed by the housing; an operating mechanism for opening and closing the separable contacts, the operating mechanism comprising a poleshaft and a trip D-shaft; and a trip assembly comprising: a yoke assembly comprising a yoke member and a trip pin coupled to the yoke member, the yoke member being coupled to the poleshaft, and a link assembly comprising a linking member, the linking member cooperating with each of the trip pin and the trip D-shaft. When the yoke member moves in response to a trip condition, the linking member transmits movement of the yoke member into movement of the trip D-shaft.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
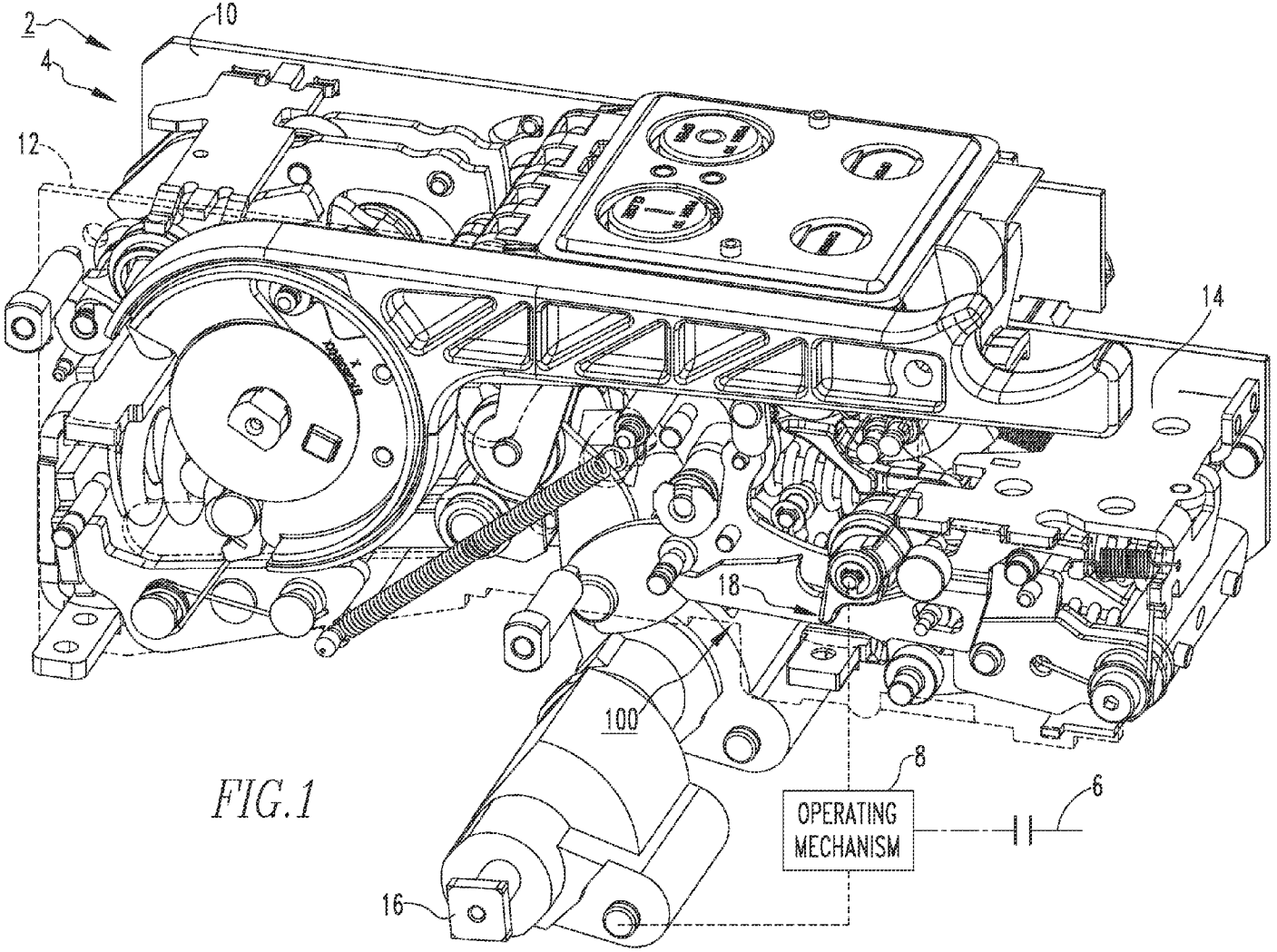
FIG. 1 is a front isometric view of a portion of a circuit breaker and a trip assembly therefor, in accordance with an embodiment of the disclosed concept.

Directional phrases used herein, such as, for example, clockwise, counterclockwise, left, right, upward, downward and derivatives thereof, relate to the orientation of the elements shown in the drawings and are not limiting upon the claims unless expressly recited therein.

As employed herein, the term "trip condition" refers to any abnormal electrical condition which could cause a circuit breaker or other electrical switching apparatus to trip expressly including, without limitation, an overcurrent condition, an overload condition, an undervoltage condition, or a relatively high level short circuit or fault condition.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a portion of an electrical switching apparatus, such as a circuit breaker 2, employing a trip assembly 100 in accordance with the disclosed concept. The circuit breaker 2 includes a housing 4 (partially shown in dashed line drawing), separable contacts 6 (shown in simplified form in FIG. 1) enclosed by the housing 4, and an operating mechanism 8 (partially shown in simplified form in FIG. 1) for opening and closing the separable contacts 6. The housing 4 includes a first side plate 10, a second side plate 12 (shown in dashed line drawing in FIG. 1, see also FIG. 2), and a connecting plate such as, for example, spring release bridge 14. The first side plate 10 is located opposite and distal the second side plate 12. The spring release bridge 14 extends laterally outwardly from the first side plate 10 and connects the first side plate 10 to the second side plate 12. The trip assembly 100 is substantially located between the first side plate 10 and the second side plate 12. The operating mechanism 8 includes a poleshaft 16 and a trip D-shaft 18 structured to trip open the separable contacts 6.

Figure 2:
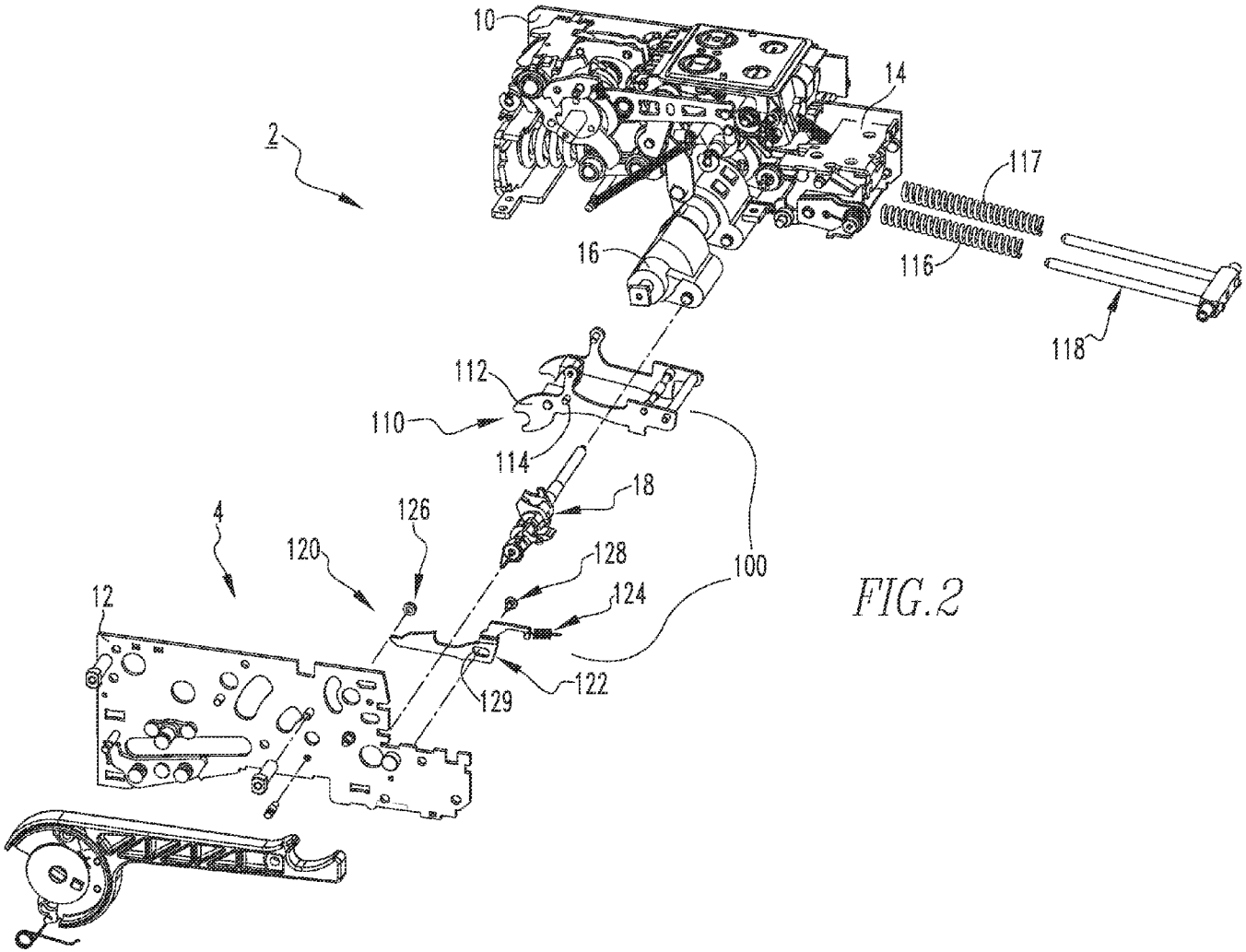
FIG. 2 is an exploded isometric view of the portion of the circuit breaker and trip assembly therefor of FIG. 1.

Referring to the exploded view of FIG. 2, the trip assembly 100 shown and described herein includes a yoke assembly 110 and a link assembly 120. The yoke assembly 110 has an opening spring yoke member 112, a trip pin 114 coupled to the yoke member 112, a number of opening springs (see, for example, two opening springs 116,117), and an opening spring seat assembly 118 extending at least partially into the opening springs 116,117. The yoke member 112 is coupled to the poleshaft 16. The opening springs 116,117 are structured to bias the yoke member 112 away from the spring release bridge 14 and, in particular, into engagement with the poleshaft 16 in a generally well known manner. The yoke assembly 110 facilitates movement of the pole shaft 16 of the circuit breaker 2, for example, in order to open, close, or trip open the separable contacts 6 of the circuit breaker 2, as desired.

The link assembly 120 includes a linking member 122, a biasing element such as an example spring 124, a cam button 126, and a retaining pin 128. The linking member 122 cooperates with each of the trip pin 114 and the trip D-shaft 18 in order to transmit movement of the yoke member 112 into movement of the trip D-shaft 18, thereby enhancing the tripping capability of the circuit breaker 2, as will be described in greater detail hereinbelow. The linking member 122 has a slot 129. The retaining pin 128 extends through the slot 129 and is coupled to the second side plate 12 in order to movably retain the linking member 122 on the second side plate 12. Preferably, the retaining pin 128 is riveted to the second side plate 12. The cam button 126 is coupled to the second side plate 12, preferably being riveted to the second side plate 12. Furthermore, the cam button 126 extends from the second side plate 12 laterally outwardly toward the yoke member 112.

Figure 3:
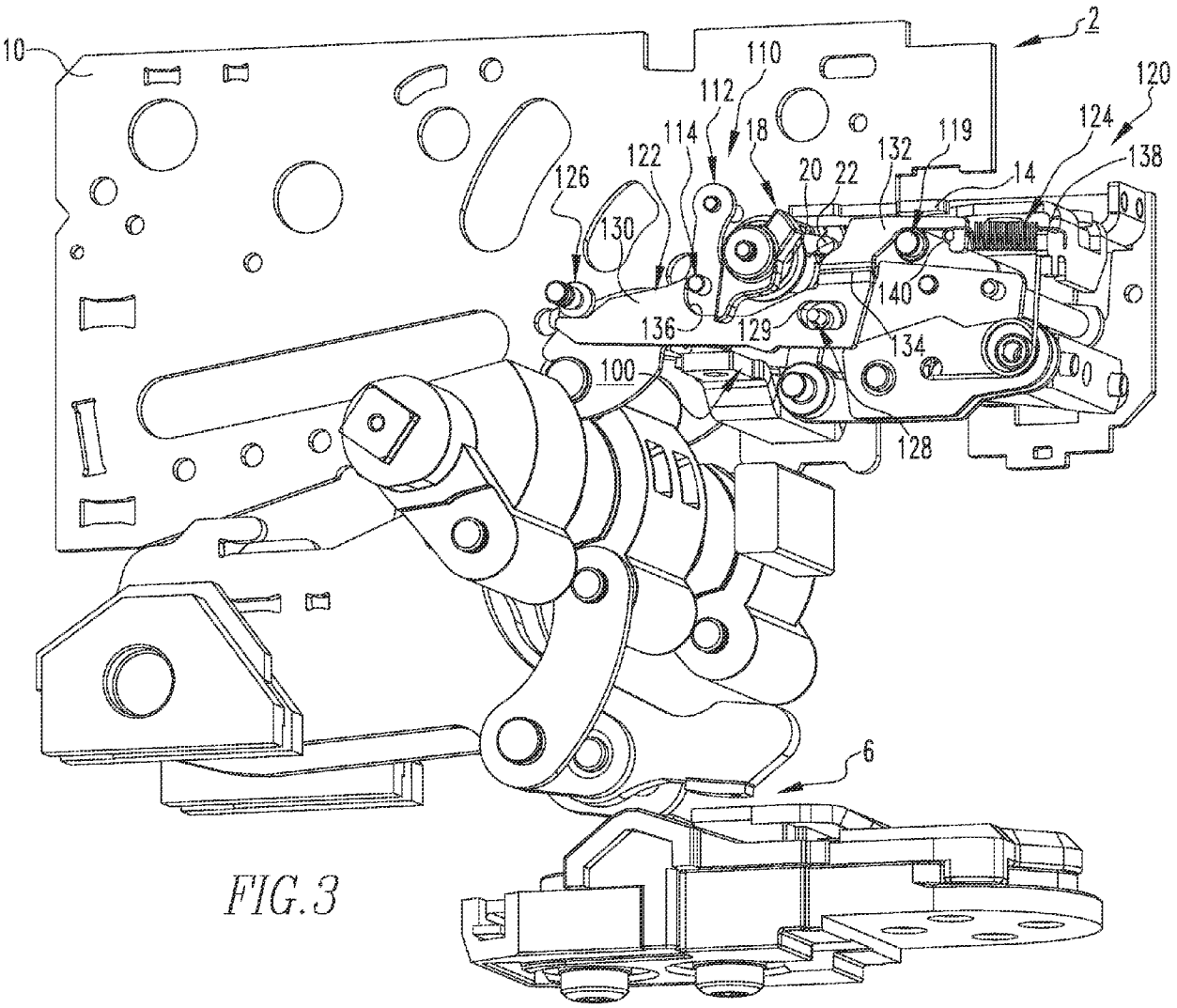
FIG. 3 is a back isometric view of the portion of the circuit breaker and trip assembly therefor of FIG. 1.

As shown in FIG. 3, the trip D-shaft 18 includes a body 20 and an actuation pin 22 that extends from the body 20. The linking member 122 includes a first portion 130, a second portion 132, and a third portion 134. The first portion 130 and the second portion 132 are generally parallel to and offset from one another. The third portion 134 connects the first portion 130 to the second portion 132 and is generally transverse to each of the first portion 130 and the second portion 132. In this manner, the first portion 130 of the linking member 122 is structured to be driven by the trip pin 114, while the second portion 132 of the linking member 122 is structured to drive the actuation pin 22 of the trip D-shaft 18. Stated differently, the offset nature of the linking member 122 allows the opening motion of the yoke assembly 110 to be utilized to interact with the actuation pin 22. More specifically, the force of the second portion 132 of the linking member 122 on the actuation pin 22 advantageously assists in overcoming the relatively high interruption forces during tripping in order to ensure that the separable contacts 6 remain fully tripped open, as will be discussed in greater detail hereinbelow.

Continuing to refer to FIG. 3, the spring 124 has a first end 138 and a second end 140 opposite and distal from the first end 138. The first end 138 is coupled to the spring release bridge 14 and is generally fixed with respect to the spring release bridge 14. The second end 140 is coupled to the linking member 122. The spring 124 biases the linking member 122 away from the cam button 126 in order to allow the link assembly 120 to reset, as will be discussed in greater detail hereinbelow. Additionally, the yoke assembly 110 further includes a yoke guide pin 119 that engages the yoke member 112. Because the spring 124 biases the linking member 122 away from the cam button 126, the yoke guide pin 119 causes a moment on the linking member 122, which in the depicted Figures is in the clockwise direction.

Figure 4:
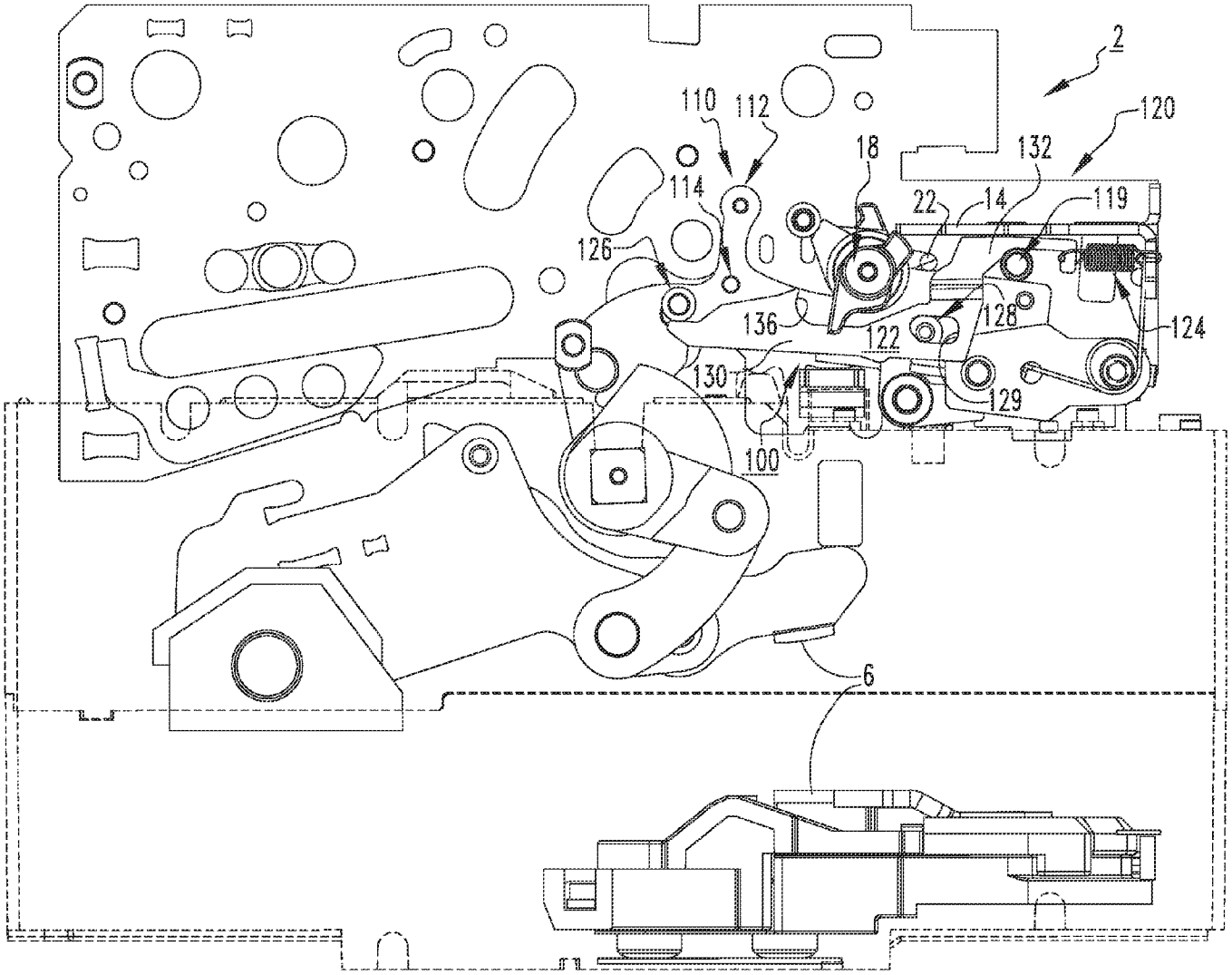
FIG. 4 is a side elevation view of the trip assembly of FIG. 3, shown in the orientation corresponding to the circuit breaker being charged and open, with a portion of the circuit breaker shown in phantom line drawing to show hidden structures.
Figure 5:
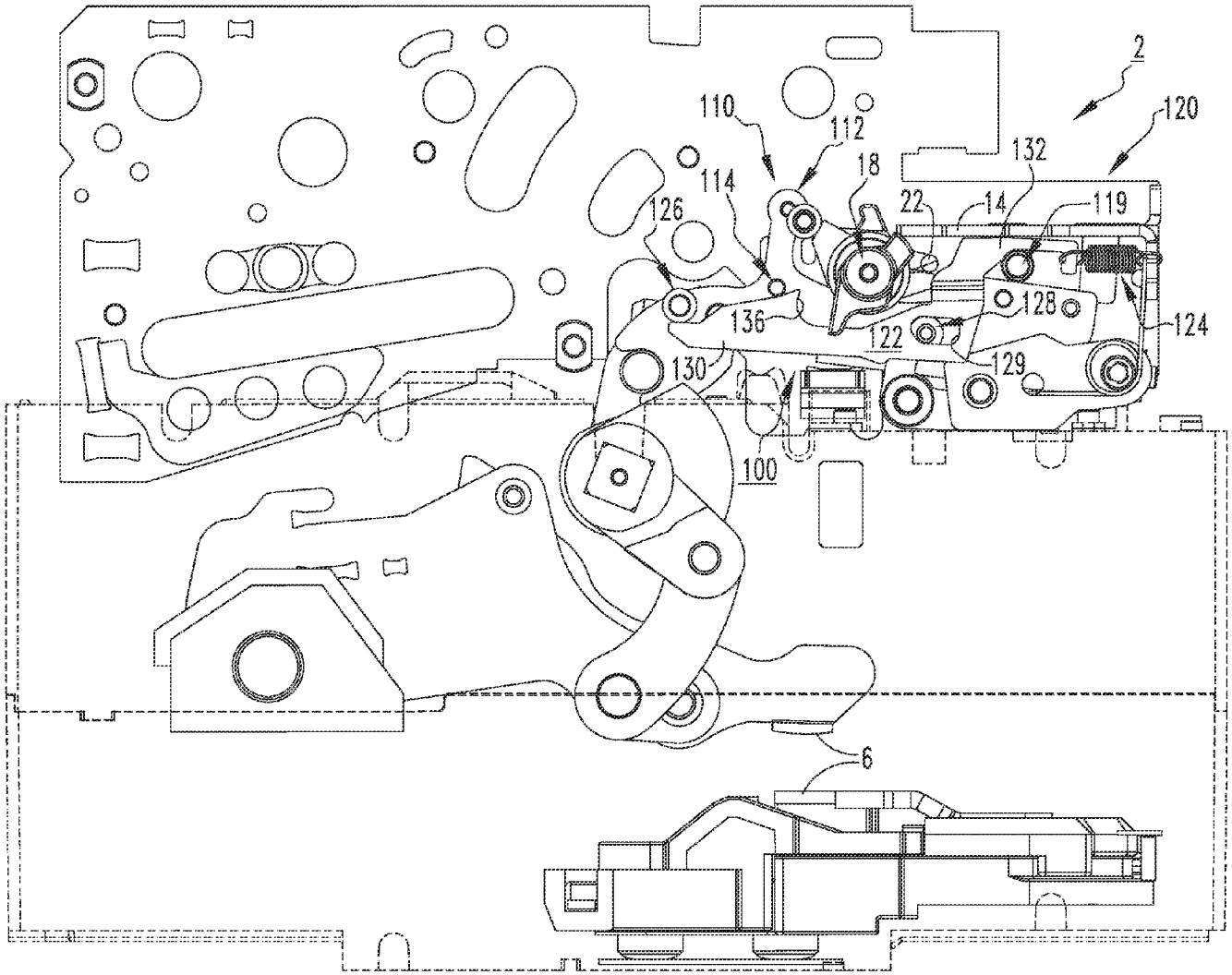
FIGS. 5 and 6 are side elevation views of the trip assembly of FIG. 4, shown in the orientation corresponding to the circuit breaker closing.
Figure 6:
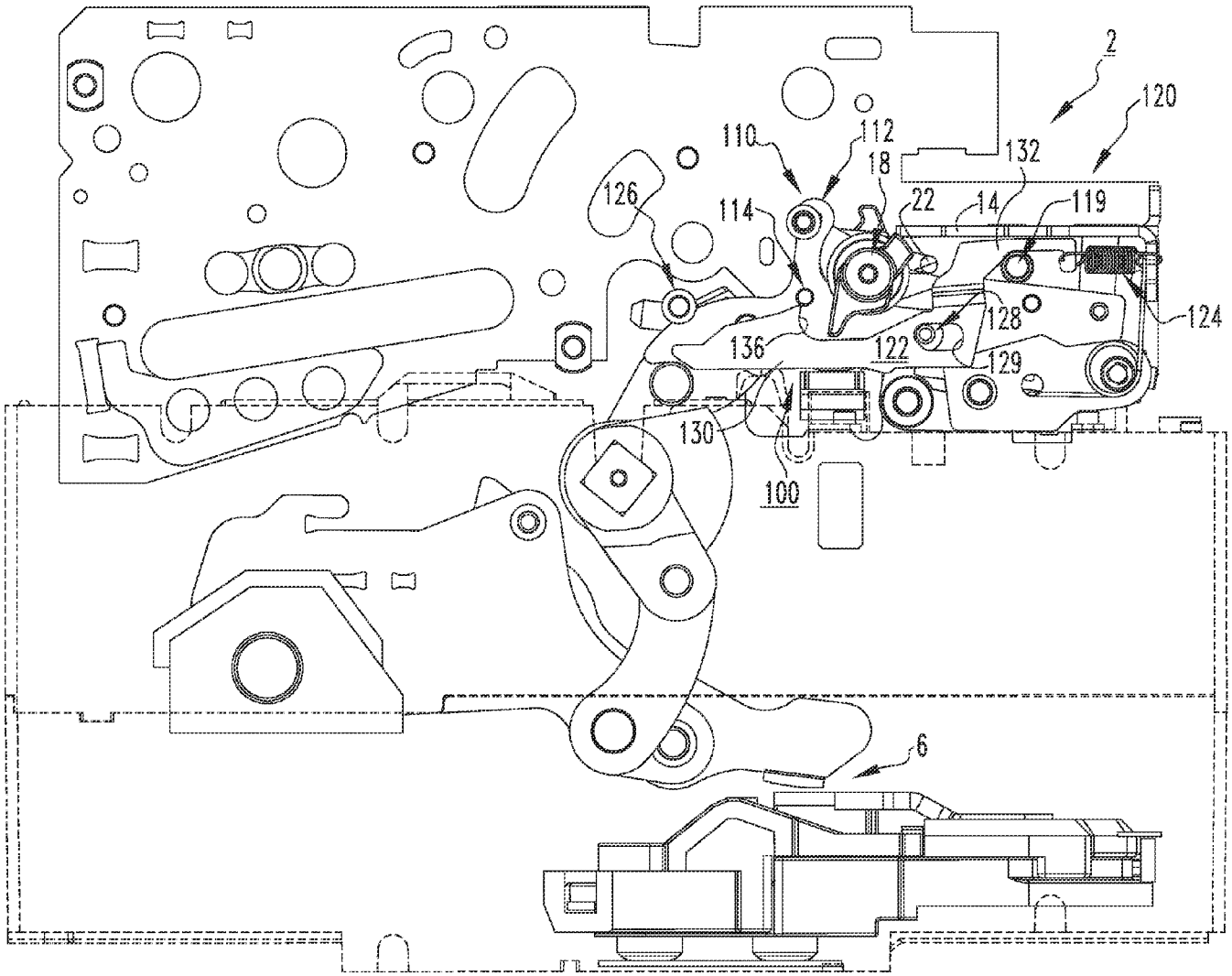

FIG. 4 shows the circuit breaker 2 and, in particular, the components of the trip assembly 100 therefor, located in their respective positions corresponding to the circuit breaker 2 being open and charged. FIGS. 5 and 6 show the circuit breaker 2 and trip assembly 100 therefor, located in different positions corresponding to the circuit breaker 2 closing.

Figure 7:
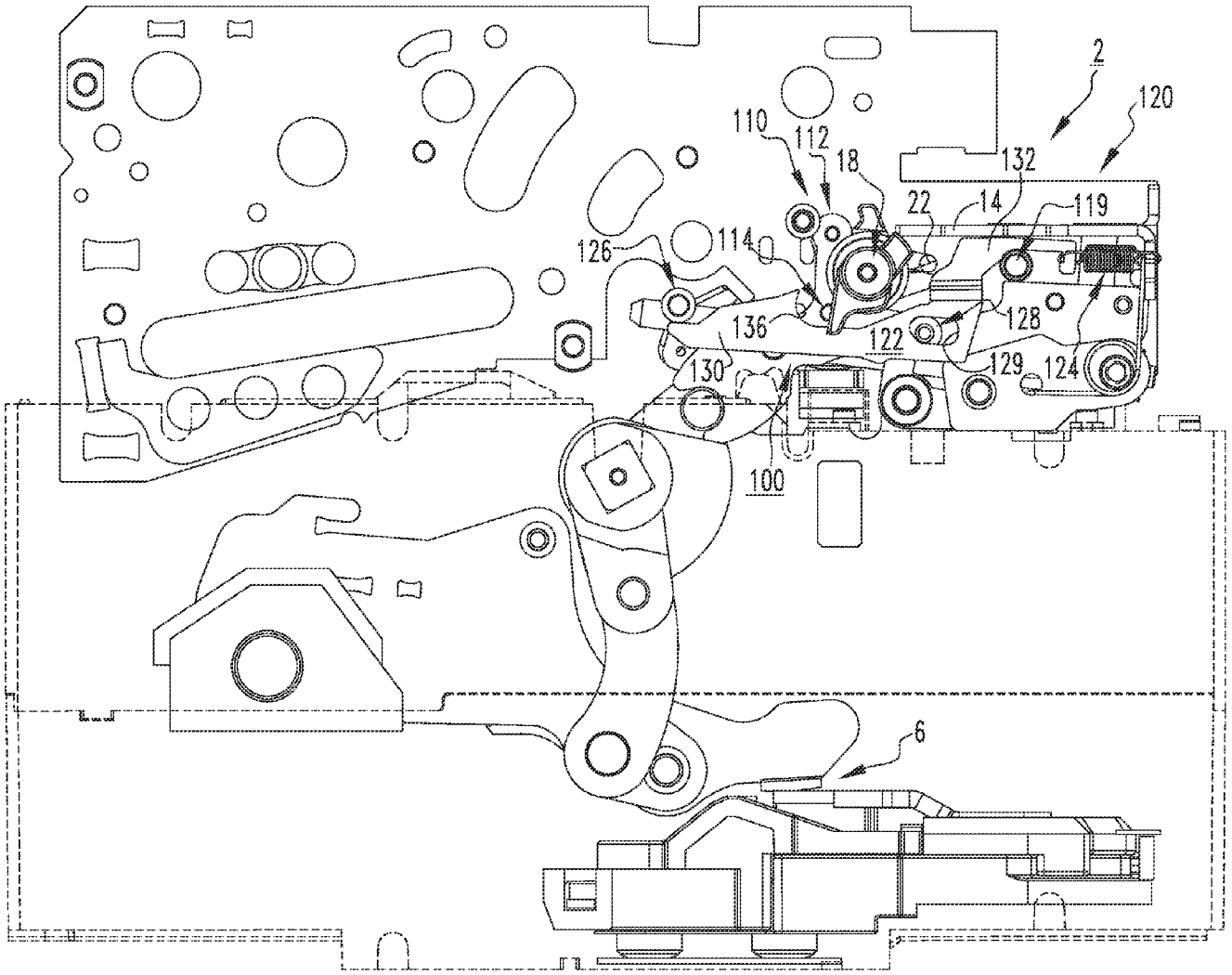
FIG. 7 is a side elevation view of the trip assembly of FIG. 6, shown in the orientation corresponding to the circuit breaker being closed.

When the circuit breaker 2 is closing, it is important that the actuation pin 22 is not inadvertently contacted, which could cause an undesirable tripping motion. Thus, when the circuit breaker 2 moves from its position in FIG. 5 to its position in FIG. 6 (i.e., as the separable contacts 6 are closing), the linking member 122 advantageously does not contact the actuation pin 22. First, the linking member 122 moves away from the actuation pin 22. More specifically, the linking member 122 is driven by the trip pin 114 and pivots about (i.e., with respect to) the yoke guide pin 119, which in the depicted Figures is the counterclockwise direction. Additionally, when the circuit breaker 2 is moving from its position in FIG. 6 to its position in FIG. 7 (i.e., a position in which the separable contacts 6 are fully closed), the trip pin 114 disengages the linking member 122, and as a result the moment exerted on the linking member 122 by the yoke guide pin 119 causes the linking member 122 to pivot about (i.e., with respect to) the yoke guide pin 119 in the opposite direction, which in the depicted Figures is the clockwise direction. However, in order to prevent inadvertent contact with the actuation pin, the linking member 122 is prevented from continued rotation by the cam button 126. Thus, when the circuit breaker 2 moves from its position in FIG. 6 to its position in FIG. 7, the linking member 122 moves toward the cam button 126 until it in fact engages the cam button 126, as shown in FIG. 7, thereby preventing the actuation pin 22 from being inadvertently contacted and causing undesirable tripping of the separable contacts 6. In other words, during the closing of the circuit breaker 2, the actuation pin 22 is not contacted by the linking member 122.

Figure 8:
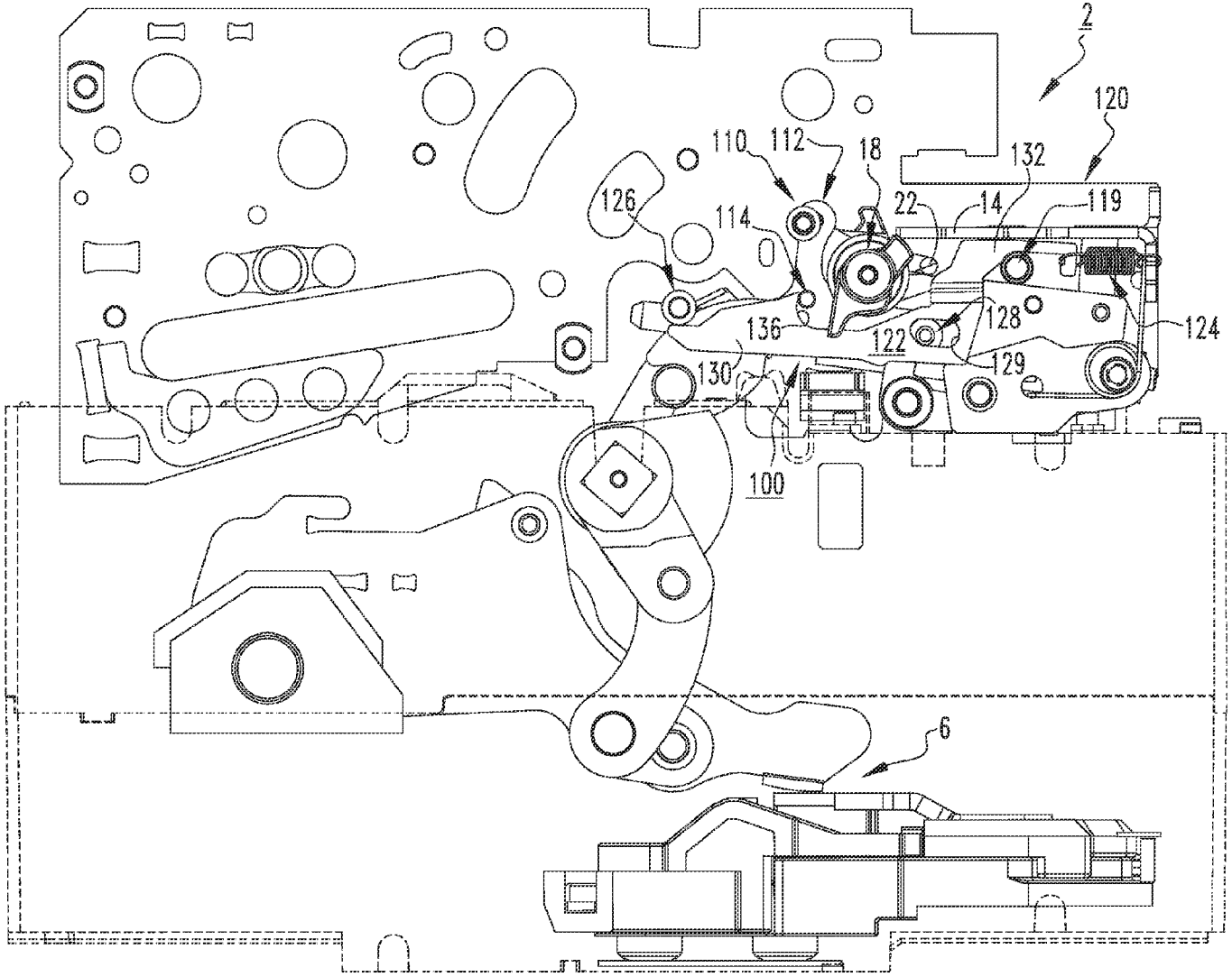
FIGS. 8 and 9 are side elevation views of the trip assembly of FIG. 7, shown in the orientation corresponding to the circuit breaker tripping open.
Figure 9:
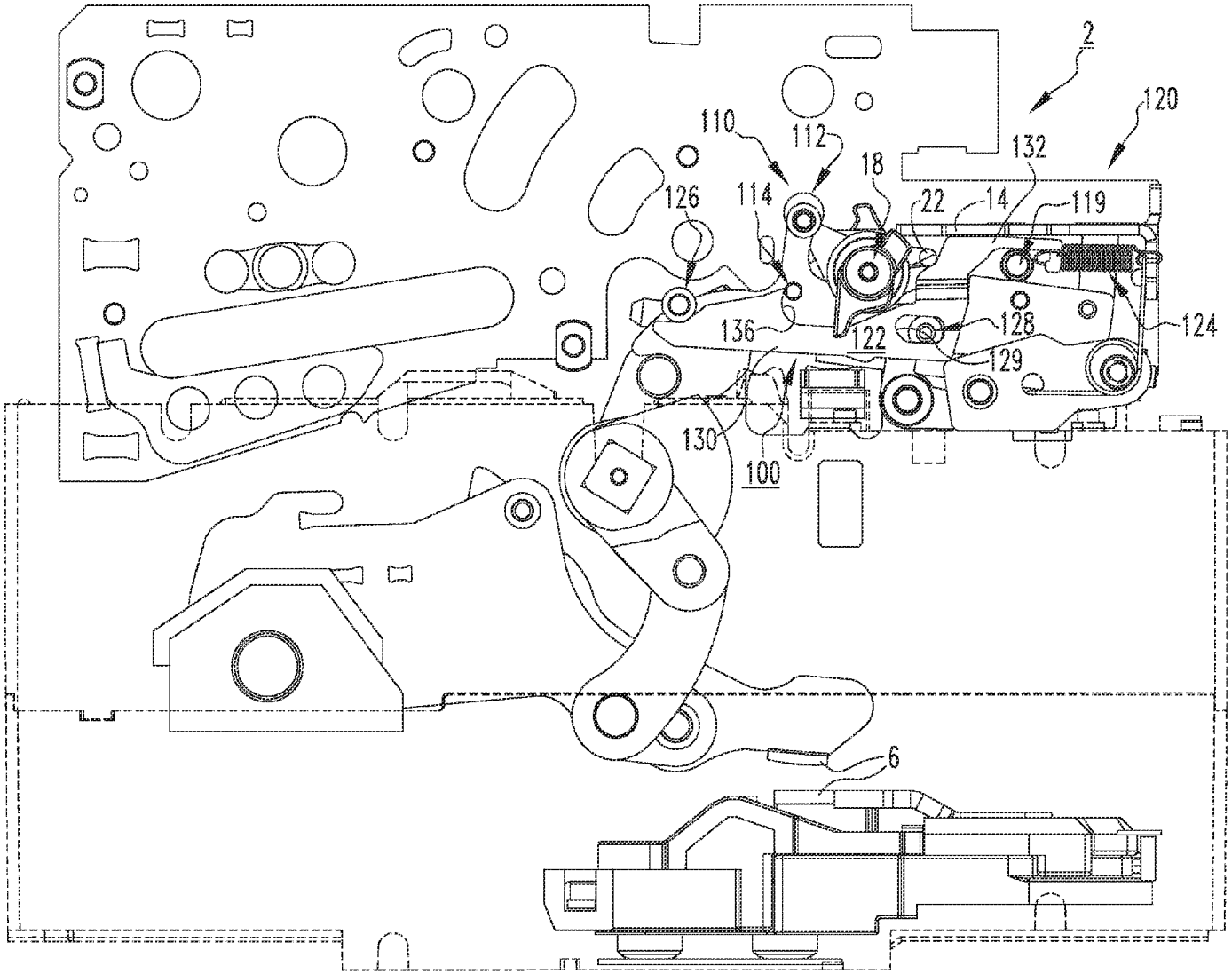
Figure 10:
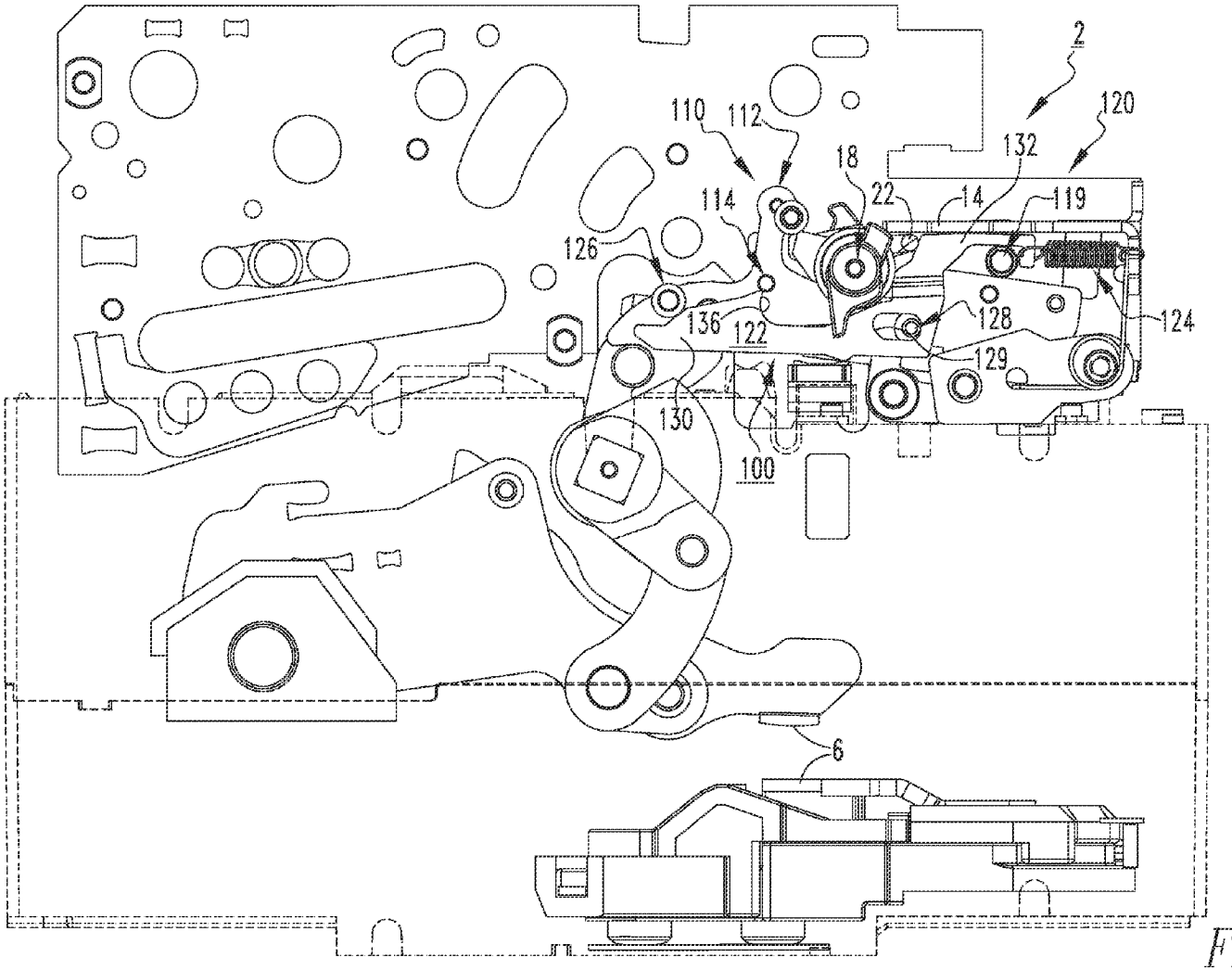
FIG. 10 is a side elevation view of the trip assembly of FIG. 9, shown in the orientation corresponding to the circuit breaker having tripped open.

FIG. 7 shows the circuit breaker 2 and trip assembly 100 therefor in a first position corresponding to the separable contacts 6 being closed. As shown, when the yoke assembly 110 is in the first position, the trip pin 114 is spaced from the linking member 122. Continuing to refer to FIG. 7, the first portion 130 of the linking member 122 has a hook-shaped receiving portion 136 that is structured to receive and be driven by the trip pin 114. More specifically, when the circuit breaker 2 trips in response to a trip condition, the trip pin 114 moves toward the receiving portion 136 and engages the receiving portion 136 (see, for example, FIGS. 8 and 9). FIG. 8 shows the circuit breaker 2 and trip assembly 100 therefor in a second position, when the circuit breaker 2 has just begun to trip in response to a trip condition. FIG. 9 shows the circuit breaker 2 and trip assembly 100 therefor in a third position, while the circuit breaker is still tripping, but after the second position (i.e., in time between the second position (FIG. 8) and a fourth position corresponding to the separable contacts 6 being fully tripped open, as shown in the example of FIG. 10).

When the yoke assembly 110 is in the second position (FIG. 8), the trip pin 114 has just engaged the receiving portion 136 of the linking member 122. When the trip pin 114 engages the receiving portion 136, the linking member 122 is structured to transmit movement of the yoke member 112 into movement of the trip D-shaft 18. More precisely, when the yoke assembly 110 moves from the second position (FIG. 8) to the third position (FIG. 9), the trip pin 114 drives the first portion 130 of the linking member 122. By employing the slot 129, the linking member 122 is advantageously able to be driven by the trip pin 114 and move with respect to the second side plate 12 (FIGS. 1 and 2) and/or with respect to the cam button 126.

As the linking member 122 is being driven by the trip pin 114 (i.e., simultaneously), the second portion 132 of the linking member 122 drives the actuation pin 22 in order to advantageously exert an additional force on the trip D-shaft 18. The additional force, which creates a moment on the trip D-shaft 18 in the same direction as the direction (i.e., in the depicted Figures this direction is counterclockwise, see for example the rotation of the trip D-shaft from the first position (FIG. 7) to the fourth position (FIG. 10)) that the trip D-shaft 18 is rotating during tripping, substantially enhances the ability of the trip D-shaft 18 to trip open the separable contacts 6, such as for example, to overcome the relatively high interruption forces created during a tripping event (i.e., responsive to a trip condition). Thus, when the yoke member 112 moves in response to a trip condition (i.e., when the circuit breaker 2 moves from the first position (FIG. 7) to the fourth position (FIG. 10)), the trip pin 114 drives the linking member 122 into the trip D-shaft 18 in order to trip open the separable contacts 6.

As shown in FIGS. 7 and 8, the actuation pin 22 is spaced from the spring release bridge 14. When the yoke assembly 110 moves from the second position (FIG. 8) to the third position (FIG. 9), the actuation pin 22 is driven toward (i.e., moves toward or moves closer to) the spring release bridge 14 by the second portion 132 of the linking member 122. Finally, when the yoke assembly 110 moves from the third position (FIG. 9) to the fourth position (FIG. 10), the actuation pin 22 continues to move toward the spring release bridge 14 until the actuation pin 22 in fact engages the spring release bridge 14, as shown in the example of FIG. 10. Additionally, when the yoke assembly 110 moves from the third position (FIG. 9) to the fourth position (FIG. 10), the linking member 122 pivots about the yoke guide pin 119 in order to drive the actuation pin 22 toward the spring release bridge 14. More precisely, the moment exerted on the linking member 122 by the yoke guide pin 119 (i.e., a moment in the clockwise direction, with respect to the depicted Figures) advantageously drives the linking member 122 into the actuation pin 22. An additional advantage of the moment exerted by the yoke guide pin 119 on the linking member 122 is that it causes the linking member 122 to maintain contact (i.e., engagement) with the cam button 126 during tripping, which is exerting a moment on the linking member 122 in an opposing direction (i.e., counterclockwise in the depicted Figures).

When the yoke assembly 110 moves from the third position (FIG. 9) to the fourth position (FIG. 10), the trip pin 114 moves from a position (FIG. 9) in which the trip pin 114 engages the receiving portion 136, to a position (FIG. 10) in which the trip pin 114 has disengaged the receiving portion 136. This effect is advantageously caused by the cam button 126. The reason is to allow the linking member 122 to slide on the cam button 126 during a trip condition. It will be appreciated that because the cam button 126 is fixed with respect to the second side plate 12 (FIGS. 1 and 2), the cam button 126 effectively drives (i.e., exerts a force on) the linking member 122 and causes the linking member 122 to generally pivot about (i.e., with respect to) the yoke guide pin 119.

The reason for the pivoting functionality of the linking member 122 is to allow the trip pin 114 to disengage the receiving portion 136, thereby allowing the link assembly 120 to reset. Thus, when the yoke member 112 moves in response to a trip condition, the linking member 122 slides on the cam button 126 in order to move away from the trip pin 114. For example and without limitation, when the yoke assembly 110 moves from the first position (FIG. 7) to the fourth position (FIG. 10), the linking member 122 generally pivots about (i.e., with respect to) the yoke guide pin 119 and rotates, which in the depicted Figures is in the counterclockwise direction. When the linking member 122 is pivoting in said direction, the trip pin 114 is sliding on the hook-shaped receiving portion 136 (i.e., while simultaneously driving the linking member 122).

In the second position (FIG. 8) and the third position (FIG. 9), the spring 124, which biases the linking member 122 away from the cam button 126, is prevented from pulling the linking member 122 back to the first position (FIG. 7) by the receiving portion 136 and in particular, by the engagement between the trip pin 114 and the receiving portion 136. When the trip pin 114 slides on the receiving portion 136 to the fourth position (FIG. 10)(i.e., when the trip pin 114 has disengaged the receiving portion 136), the receiving portion 136 and the trip pin 114 no longer prevent the spring 124 from pulling the linking member 122 back to the first position (FIG. 7) and resetting the link assembly 120. Thus, it will be appreciated that FIG. 10 represents the first instance in time in which the trip pin 114 has disengaged the receiving portion 136. It necessarily follows that immediately following the fourth position of FIG. 10, the spring 124 will begin to pull the linking member 122 away from the cam button 126 in order to reset the link assembly 120.

Accordingly, the disclosed trip assembly 100 provides a convenient and efficient mechanical link for interfacing the yoke assembly 110 and the trip D-shaft 18 to ensure sufficient additional tripping force is applied to effectuate the tripping operation of the circuit breaker 2 in response to a trip condition. More specifically, the disclosed concept advantageously utilizes the opening motion of the yoke assembly 110 in order to provide a novel additional force on the trip D-shaft 18, thereby allowing the relatively high interruption forces to be overcome and the separable contacts 6 to be effectively tripped open.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A trip assembly for an electrical switching apparatus, said electrical switching apparatus comprising a housing, separable contacts enclosed by said housing, and an operating mechanism for opening and closing said separable contacts, said operating mechanism comprising a poleshaft and a trip D-shaft, said trip assembly comprising:

a yoke assembly comprising a yoke member and a trip pin coupled to said yoke member, said yoke member being structured to be coupled to said poleshaft; and a link assembly comprising a linking member, said linking member being structured to cooperate with each of said trip pin and said trip D-shaft, wherein, when said yoke member moves in response to a trip condition, said linking member is structured to transmit movement of said yoke member into movement of said trip D-shaft; wherein said link assembly further comprises a cam button structured to be coupled to said housing; and wherein, when said yoke member moves in response to a trip condition, said linking member is structured to slide on said cam button in order to move away from said trip pin.

2. The trip assembly of claim 1 wherein said link assembly further comprises a biasing element; wherein said biasing element comprises a first end and a second end disposed opposite and distal from the first end; wherein the first end is structured to be coupled to the housing; wherein the second end is coupled to said linking member; and wherein said biasing element is structured to bias said linking member away from said cam button.

3. The trip assembly of claim 2 wherein said linking member comprises a receiving portion; wherein said trip pin is structured to engage the receiving portion; wherein, when said trip pin engages the receiving portion, said linking member is structured to transmit movement of said yoke member into movement of said trip D-shaft; and wherein, when said trip pin engages the receiving portion, the receiving portion prevents said biasing element from pulling said linking member away from said cam button.

4. The trip assembly of claim 2 wherein said linking member comprises a receiving portion; wherein said yoke assembly is structured to move between a first position and a second position; wherein, when said yoke assembly is in the first position, said trip pin engages the receiving portion, thereby transmitting movement of said yoke member into movement of said trip D-shaft; and wherein, when said yoke assembly moves from the first position to the second position, said trip pin disengages the receiving portion, thereby allowing said biasing element to pull said linking member away from said cam button in order to reset said link assembly.

5. The trip assembly of claim 2 wherein said biasing element is a spring; wherein the housing of said electrical switching apparatus comprises a connecting plate; and wherein the first end of said spring is structured to be coupled to said connecting plate.

6. A trip assembly for an electrical switching apparatus, said electrical switching apparatus comprising a housing, separable contacts enclosed by said housing, and an operating mechanism for opening and closing said separable contacts, said operating mechanism comprising a poleshaft and a trip D-shaft, said trip assembly comprising:

a yoke assembly comprising a yoke member and a trip pin coupled to said yoke member, said yoke member being structured to be coupled to said poleshaft; and a link assembly comprising a linking member, said linking member being structured to cooperate with each of said trip pin and said trip D-shaft, wherein, when said yoke member moves in response to a trip condition, said linking member is structured to transmit movement of said yoke member into movement of said trip D-shaft; wherein said linking member comprises a first portion, a second portion, and a third portion; wherein the first portion is structured to be driven by said trip pin; wherein the second portion is structured to drive said trip D-shaft; wherein the first portion is generally parallel to and offset from the second portion; wherein the third portion is generally transverse to each of the first portion and the second portion; and wherein the third portion connects the first portion to the second portion.

7. An electrical switching apparatus comprising:

a housing;

separable contacts enclosed by said housing;

an operating mechanism for opening and closing said separable contacts, said operating mechanism comprising a poleshaft and a trip D-shaft; and a trip assembly comprising:

a yoke assembly comprising a yoke member and a trip pin coupled to said yoke member, said yoke member being coupled to said poleshaft, and a link assembly comprising a linking member, said linking member cooperating with each of said trip pin and said trip D-shaft, wherein, when said yoke member moves in response to a trip condition, said linking member transmits movement of said yoke member into movement of said trip D-shaft; wherein said housing comprises a connecting plate; wherein said trip D-shaft comprises a body and an actuation pin extending from said body; wherein said yoke assembly is structured to move between a first position and a second position; wherein the first position corresponds to said separable contacts being closed; wherein the second position corresponds to said separable contacts being tripped open; wherein, when said yoke assembly is in the first position, said actuation pin is spaced from said connecting plate; and wherein, when said yoke assembly is in the second position, said actuation pin engages said connecting plate.

8. The electrical switching apparatus of claim 7 wherein, when said yoke member moves in response to a trip condition, said trip pin drives said linking member into said trip D-shaft in order to trip open said separable contacts.

9. The electrical switching apparatus of claim 8 wherein said linking member comprises a first portion and a second portion offset from the first portion; wherein the first portion is structured to be driven by said trip pin; and wherein the second portion is structured to drive said trip D-shaft.

10. The electrical switching apparatus of claim 9 wherein, when said yoke member moves in response to a trip condition, the second portion of said linking member drives said actuation pin in order to trip open said separable contacts.

11. The electrical switching apparatus of claim 7 wherein said linking member comprises a first portion and a second portion; wherein the first portion is structured to be driven by said trip pin; and wherein, when said yoke assembly moves from the first position to the second position, the second portion of said linking member drives said actuation pin into said connecting plate in order to trip open said separable contacts.

12. The electrical switching apparatus of claim 7 wherein said yoke assembly further comprises a yoke guide pin engaging said yoke member; and wherein, when said yoke assembly moves from the first position to the second position, said linking member pivots about said yoke guide pin in order to drive said actuation pin toward said connecting plate.

13. The electrical switching apparatus of claim 7 wherein said link assembly further comprises a retaining pin coupled to said housing; wherein said linking member has a slot; and wherein said retaining pin extends through the slot in order to movably retain said linking member on said housing.

14. The electrical switching apparatus of claim 13 wherein said retaining pin is riveted to said housing.

15. The electrical switching apparatus of claim 7 wherein said electrical switching apparatus is a circuit breaker; wherein said housing further comprises a first side plate and a second side plate; wherein said connecting plate is a spring release bridge connecting said first side plate to said second side plate; and wherein said trip assembly is substantially disposed between said first side plate and said second side plate.

16. An electrical switching apparatus comprising:

a housing;

separable contacts enclosed by said housing;

an operating mechanism for opening and closing said separable contacts, said operating mechanism comprising a poleshaft and a trip D-shaft; and a trip assembly comprising:

a yoke assembly comprising a yoke member and a trip pin coupled to said yoke member, said yoke member being coupled to said poleshaft, and a link assembly comprising a linking member, said linking member cooperating with each of said trip pin and said trip D-shaft, wherein, when said yoke member moves in response to a trip condition, said linking member transmits movement of said yoke member into movement of said trip D-shaft;

wherein said link assembly further comprises a biasing element; wherein said biasing element comprises a first end and a second end disposed opposite and distal from the first end of said biasing element; wherein the housing of said electrical switching apparatus comprises a spring release bridge; wherein the first end of said spring is coupled to said spring release bridge; wherein the second end of said spring is coupled to said linking member; wherein the housing of said electrical switching apparatus further comprises a side plate; wherein said spring release bridge extends laterally outwardly from said side plate; wherein said link assembly further comprises a cam button coupled to said side plate; wherein said cam button extends laterally outwardly from said side plate toward said yoke member; and wherein, when said yoke member moves in response to a trip condition, said linking member is structured to slide on said cam button in order to move away from said trip pin.

* * * * *